US006858988B1

(12) United States Patent
Laroussi

(10) Patent No.: US 6,858,988 B1
(45) Date of Patent: Feb. 22, 2005

(54) ELECTRODELESS EXCIMER UV LAMP

(75) Inventor: Mounir Laroussi, Virginia Beach, VA (US)

(73) Assignee: Old Dominion University Research Foundation, Norfolk, VA (US)

( * ) Notice: Subject to any disclaimer, the term of this patent is extended or adjusted under 35 U.S.C. 154(b) by 184 days.

(21) Appl. No.: 10/284,113

(22) Filed: Oct. 30, 2002

Related U.S. Application Data

(60) Provisional application No. 60/336,355, filed on Oct. 31, 2001.

(51) Int. Cl.[7] ..... H01J 7/24; H01J 65/00

(52) U.S. Cl. ..... 315/111.21; 313/607; 156/345.1

(58) Field of Search ..... 313/607, 493, 313/35, 36, 634, 248, 344; 315/111.21, 111.51, 111.71, 111.81, 111.91, 248, 344; 156/345.1, 345.43

(56) References Cited

U.S. PATENT DOCUMENTS 4,053,814 A * 10/1977 Regan et al. ..... 315/248
5,289,085 A * 2/1994 Godyak et al. ..... 315/248
5,414,324 A 5/1995 Roth et al. ..... 315/111.21
5,569,810 A * 10/1996 Tsuji ..... 588/227
5,876,663 A 3/1999 Laroussi ..... 315/111.21
5,883,470 A * 3/1999 Hatakeyama et al. ... 315/111.51
6,087,774 A * 7/2000 Nakayama et al. ..... 313/607
6,177,763 B1 * 1/2001 Morrow ..... 313/607
6,204,605 B1 3/2001 Laroussi et al. ..... 315/111.71

* cited by examiner

*Primary Examiner*—Wilson Lee
(74) *Attorney, Agent, or Firm*—Bowman Green Hampton & Kelly PLLC

(57) ABSTRACT

An electrodeless excimer UV lamp, comprising an enclosed chamber with a gas sealed within the enclosed chamber, wherein the gas is capable of being used to generate a plasma discharge, a first electrode wrapped around the outer surface of the chamber at a first location, a second electrode wrapped around the outer surface of the chamber at second location, and a power supply configured to apply a voltage to the first electrode and the second electrode. During operation of the UV lamp, a plasma discharge is generated by applying a voltage to the electrodes wrapped around the outer surface of the chamber to ignite the gas or gas mixture inside the chamber and generate a plasma discharge within the chamber, such that a specific wavelength of UV radiation will be generated by the particular gas within the chamber.

41 Claims, 5 Drawing Sheets

ELECTRODELESS EXCIMER UV LAMP

This application is a continuation of U.S. provisional patent application No. 60/336,355, filed Oct. 31, 2001.

This invention was made in part using funds from the Federal government under contract number F49620-00-1-0168 from the United States Air Force Office of Scientific Research (AFOSR) and the Virginia Graduate Marine Science Consortium under contract number 5-29467. Accordingly, the federal government and the Commonwealth of Virginia have certain rights in this invention.

BACKGROUND OF THE INVENTION

1. Field of the Invention

This invention relates to excimer UV lamps.

2. Description of Related Art

Generally, it is known that excimers (excited dimers) are excited molecules with no stable ground state. They are formed via three body reactions involving excited-state atoms and ground state atoms. Excimers are normally unstable and decay in few nanoseconds, yielding incoherent radiation in the ultra-violet (UV) and vacuum ultra-violet (VUV) range. Excimers can be formed in high pressure, non-equilibrium, gas discharges such as the Dielectric Barrier Discharge (DBD).

Excimer formation typically occurs at high pressures where the collision rates are high. Therefore, a non-equilibrium, atmospheric pressure discharge provides an ideal source of excimers. In the market today, excimer UV lamps have generally a cylindrical configuration and are based on a silent discharge. This silent discharge is normally generated by applying an AC voltage to electrodes, which are insulated by a dielectric material. The applied AC voltage ionizes specific gases that are located between and within the vicinity of the electrodes and generate plasma discharges between the electrodes. The electrodes are powered by a RF source with voltages in the kilovolts range and frequencies in the kilohertz to megahertz range.

Excimer lamps typically emit ultra-violet (UV) radiation at specific wavelengths and known excimer lamps are usually used in industrial applications for decontamination or disinfection of materials, surface modifications of materials, material deposition, pollution control, and UV curing.

SUMMARY OF THE INVENTION

Unfortunately, known excimer lamps employ a geometry that renders them relatively inefficient. For example, known excimer lamps include a perforated metal or a mesh-like metallic outer electrode with a cylindrical geometry that blocks a substantial portion of the emitted UV radiation and therefore prevents a substantial portion of the emitted UV radiation from propagating outside the lamp. For most applications, such as, for example, the decontamination of a liquid, it is advantageous to maximize the UV emitting area.

During operation of known excimer lamps the plasma discharge reacts with the electrodes and, while pitting or etching the electrode material, contaminates the discharge with impurities. Electrode contamination has a negative effect on UV generation, and limits the lamp lifetime.

Accordingly, various exemplary embodiments of the systems, methods, and apparatuses of this invention provide a high pressure discharge electrodeless excimer UV lamp, in which the mesh-like outer electrode is eliminated and the generated plasma discharge is isolated from the electrodes. Summarized briefly, various exemplary embodiments of the electrodeless excimer UV lamp of this invention utilize conducting loops or conductive electrodes that are formed by two metallic rings wrapped around the outer surface of a hollow, non-conductive, cylindrical tube or chamber.

The hollow chamber is filled with a desired gas or gas mixture, as farther described herein, and then enclosed or sealed. Because the chamber is enclosed or scaled, the gas or gas mixture inside is not contaminated by particles or gasses found in the atmosphere around the electrodeless excimer UV lamp. The electrodeless excimer UV lamp is filled with a gas or gas mixture that is capable of being used to generate a plasma discharge, such as, for example, a rare gas such as helium, argon, krypton, and xenon, or a rare gas/halogen gas mixture such as krypton/chlorine, xenon/chlorine, or argon/chlorine.

Using the electrodeless excimer UV lamp of this invention, generation of a near monochromatic UV radiation is achieved, using, for example, a gas mixture containing krypton and chlorine as the operating gas mixture. For example, UV excimer radiation with a wavelength of 222 run has a very powerful germicidal effect and can be useful in liquid purification.

The ring electrodes are placed at a distance from each other and cover a comparatively small or even negligible area of the outer chamber surface. In this manner, a less significant portion of the wall surface is shadowed by the electrode(s), and a greater amount of the UV generated by the discharge inside the chamber propagates outside the chamber practically unimpeded and therefore non-attenuated.

Additionally, by placing the electrodes around the outer surface of the chamber, the electrodes do not come into contact with the discharge, but are sufficiently separated from the plasma constituents to prevent interaction with the electrode material. Therefore, no contamination of the discharge by the electrodes occurs. Furthermore, the electrodes are capacitively coupled to the plasma discharge, such that the electrodes do not function as a conductor and the electrodeless excimer UV lamp does not overheat. Therefore, a cooling system is typically not required for efficient operation of the electrodeless excimer UV lamp.

A power supply is configured to apply a voltage to the two or more electrodes to generate the plasma discharge inside the chamber. In various exemplary embodiments, the voltage is applied to the electrodes through an impedance matching network.

In various exemplary embodiments, the electrodeless excimer UV lamp includes several electrodes placed around the outer surface of the chamber in a cascaded fashion. By cascading several electrodes around the chamber, a larger discharge volume may be created within the chamber, and a larger UV emission area can be created. This ultimately increases the UV output of the excimer UV lamp.

Because the electrodeless excimer UV lamp of this invention utilizes loops or electrodes that are formed around the outer surface of a lamp chamber, in various exemplary embodiments, a given lamp chamber may be removed from the electrodes of the electrodeless excimer UV lamp and replaced by another lamp chamber. In this manner, the electrodeless excimer UV lamp of this invention may be utilized with various lamp chambers or cartridges, and each lamp cartridge may be specifically designed, for example, to provide a particular wavelength of UV radiation.

During operation of the electrodeless excimer UV lamp, a plasma discharge is generated by applying a voltage to the electrodes wrapped around the outer surface of the chamber to ignite the gas or gas mixture inside the chamber and generate a plasma discharge within the chamber.

Accordingly, this invention separately provides an excimer UV lamp of a simplified design.

This invention separately provides a scalable, electrodeless excimer UV lamp.

This invention separately provides an electrodeless excimer UV lamp with a replaceable lamp cartridge.

This invention separately provides a more efficient excimer UV lamp.

This invention separately provides an excimer UV lamp that can be utilized over an increased area.

This invention separately provides an electrodeless excimer UV lamp that may be used for material surface modification, decontamination of surfaces and liquids, UV curing, bacteria or pollution control, and/or material deposition.

Various exemplary embodiments of this invention provide a liquid purification system.

These and other features and advantages of this invention are described in or are apparent from the following detailed description of various exemplary embodiments, the accompanying drawings, and/or the appended claims.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF THE PREFERRED EMBODIMENTS

For simplicity and clarification, the layout, design factors, and operating principles of the apparatuses, systems, and methods of the electrodeless excimer UV lamp according to this invention are explained with reference to various exemplary embodiments of the apparatuses, systems, and methods of the electrodeless excimer UV lamp according to this invention. The basic explanation of the operation of the apparatuses, systems, and methods of the electrodeless excimer UV lamp is applicable for the understanding and design of the constituent components employed in the apparatuses, systems, and methods of the electrodeless excimer UV lamp of this invention.

It should be understood that the term "high pressure", as used herein, refers to pressures from a few torr to approximately a thousand torr.

It should also be understood that the term "electrodeless", as used herein, are to be understood to reflect the idea that a plasma discharge is generated within an enclosed chamber. Thus, an electrodeless discharge is created. Therefore, the term "electrodeless" is not to be construed as limiting the apparatuses, systems, or methods of this invention.

Figure 1:
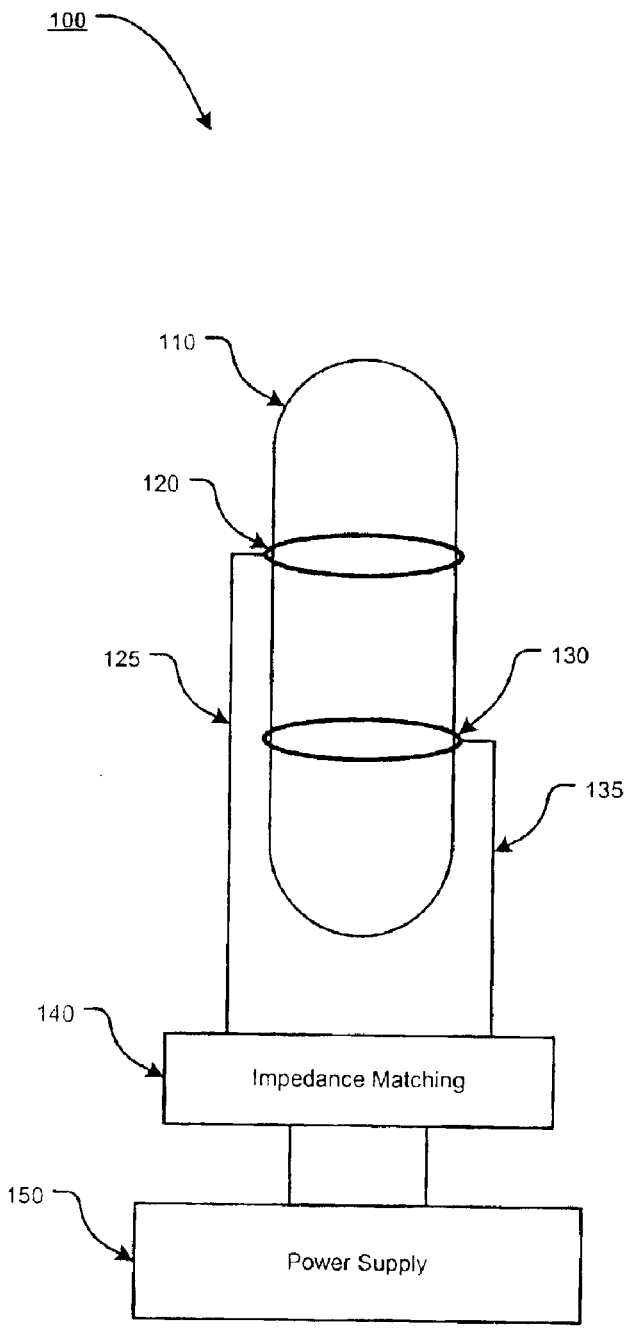
FIG. 1 shows a first exemplary embodiment of a electrodeless excimer UV lamp system according to this invention.

FIG. 1 shows a first exemplary embodiment of an electrodeless excimer UV lamp system 100 according to this invention. As shown in FIG. 1, the electrodeless excimer UV lamp system 100 includes at least some of a lamp chamber 110, a first electrode 120, a second electrode 130, and a power supply 150. The first electrode 120 and the second electrode 130 are each connected, either directly or indirectly, to the power supply 150, via a first electrode connector 125 and a second electrode connector 135, respectively. In various exemplary embodiments, the first electrode 120 and the second electrode 130 are each connected, via an impedance matching network 140, to the power supply 150.

The lamp chamber 10, or lamp cartridge, includes an inner surface and an outer surface, and is formed of a hollow tube with a gas or gas mixture enclosed therein. As shown in FIG. 1, the lamp chamber 110 has a generally cylindrical and elliptical geometry. However, it should be appreciated that various alternative geometries may be utilized.

In various exemplary embodiments, the lamp chamber 110 maybe formed from a non-conductive material that is transparent or translucent to UV propagation, such as, for example, fused silica, quartz, glass, calcium fluoride, magnesium fluoride, and the like. In other exemplary embodiments, the lamp chamber 10 may be formed primarily from a non-conductive material that is opaque to UV propagation, such as, for example, ceramic, or alumina. In these other exemplary embodiments, the lamp chamber 10 will include at least one window portion that is transparent to UV propagation, such as, for example, a transparent window on an end of the lamp chamber 10.

It should be understood that a variety of appropriate materials may be used in various exemplary embodiments of this invention to form the lamp chamber 110. Therefore, although particular materials are listed or described herein, the listed materials are exemplary and are not intended to be an exhaustive list of all possible materials that may be used to form the lamp chamber 110. The particular material that is utilized to form the lamp chamber of any particular embodiment of the electrodeless excimer UV lamp system 100 will be a design choice within the spirit and scope of this invention, which must be made for each specific application. Thus, it should be appreciated that the lamp chamber 110 maybe formed of any known or later developed suitable non-conducting material capable of containing the required gas or gas mixture.

In various exemplary embodiments, the lamp chamber 110 may be filled with a rare or noble gas or gas mixture, such as, for example, helium, argon, krypton, and xenon, or a rare gas/halogen gas mixture such as krypton/chlorine, xenon/chlorine, or argon/chlorine.

It should be understood that a variety of appropriate gasses and/or gas mixtures may be used in various exemplary embodiments of this invention. Therefore, although particular gasses and/or gas mixtures are listed or described herein, the listed gasses and/or gas mixtures are exemplary and are not intended to be an exhaustive list of all possible gasses and/or gas mixtures that may be used. The particular gas or gas mixture that is utilized in any particular embodiment of the electrodeless excimer UV lamp system 100 will be a design choice within the spirit and scope of this invention, which must be made for each specific application. Thus, any type of appropriate gas and/or gas mixture, whether currently known or later developed, is contemplated within the scope of this invention. The first electrode 120 and the second electrode 130 are each formed of a conducting or conductive material, such as, for example, copper wire or copper strip, which is wrapped around the outer surface of the lamp chamber 110. Therefore, it should be appreciated that, in various exemplary embodiments, the overall shape of the first electrode 120 and the second electrode 130 may be governed by the corresponding geometry of the lamp chamber 110.

It should be understood that a variety of appropriate materials may be used in various exemplary embodiments of this invention to form the first electrode 120 and the second electrode 130. Therefore, although particular materials are listed or described herein as being used to form the first electrode 120 and the second electrode 130, the listed materials are exemplary and are not intended to be an exhaustive list of all possible materials that may be used to form the first electrode 120 and the second electrode 130. The particular material that is utilized to form the first electrode 120 and the second electrode 130 of any particular embodiment of the electrodeless excimer UV lamp system 100 will be a design choice within the spirit and scope of this invention, which must be made for each specific application. Thus, it should be appreciated that the first electrode 120 and the second electrode 130 may be formed of any known or later developed suitable conducting or conductive material.

The first electrode 120 and the second electrode 130 are placed at a distance from each other. In various exemplary embodiments, the first electrode 120 and the second electrode 130 are placed at a distance ranging from a few millimeters to several centimeters from each other. The actual distance between the first electrode 120 and the second electrode 130 is a function of, for example, the desired discharge volume of UV radiation, the power to be supplied to the first electrode 120 and the second electrode 130, and the diameter of the lamp chamber 110.

By placing the first electrode 120 and the second electrode 130 around the outer surface of the lamp chamber 10, the electrodes do not come into contact with the gas or gas mixture contained within the lamp chamber 110 and are capacitively coupled to the resultant plasma discharge.

The power supply 150 is configured to apply a voltage, via the connectors 125 and 135, to the first electrode 120 and the second electrode 130 to generate the plasma discharge inside the lamp chamber 110. In various exemplary embodiments, the voltage is applied to the first electrode 120 and the second electrode 130 through the optional impedance matching network 140.

It should be understood that a variety of appropriate power supplies and impedance matching networks are well known to those of ordinary skill in the art, and a variety of such power supplies and impedance matching networks maybe used in various exemplary embodiments of this invention. Therefore, particular type and version of power supply and/or impedance matching network that is used in any particular embodiment of this invention will be a design choice within the spirit and scope of this invention, which must be made for each specific application. Thus, any type of power supply and/or impedance matching network, whether currently known or later developed, is contemplated within the scope of this invention.

During operation of the electrodeless excimer UV lamp system 100, a plasma discharge is generated within the lamp chamber 10 by applying an Alternating Current (AC) voltage to the first electrode 120 and the second electrode 130 wrapped around the outer surface of the chamber to ignite the gas or gas mixture inside the chamber and generate a plasma discharge within the chamber. This is accomplished using the power supply 150, the impedance matching network 140, the connectors 125 and 135, the first electrode 120, and the second electrode 130.

In various exemplary embodiments, the power supply 150 supplies an AC voltage in the range of about 200 volts to about 5 kV RMS, having a frequency in the range of about 1 kHz to about 100 MHz. The voltage and frequency supplied by the power supply 150 will vary depending upon, for example, the desired discharge volume of UV radiation, the distance between the first electrode 120 and the second electrode 130, and the diameter of lamp chamber 110. It should be understood that, for example, as these parameters increase, the amount of power required will increase as well.

When an appropriate AC voltage is applied between the first electrode 120, the second electrode 130, and the gas or gas mixture in the lamp chamber 110, a plasma discharge is generated inside the lamp chamber 110. Once created, the generated plasma discharge generally fills the volume between the first electrode 120 and the second electrode 130. Additionally, because of the geometry of the lamp chamber 110 and the lack of physical barriers within the lamp chamber 110, the plasma discharge is able to migrate throughout the entire lamp chamber 110.

Nearly monochromatic radiation emission spanning the 127 nm to 308 nm wavelength range has been routinely accomplished. Examples include 127 nm for $Ar_2$; 172 nm for $Xe_2$; 222 nm for KrCl; and 308 nm for XeCl.

Figure 2:
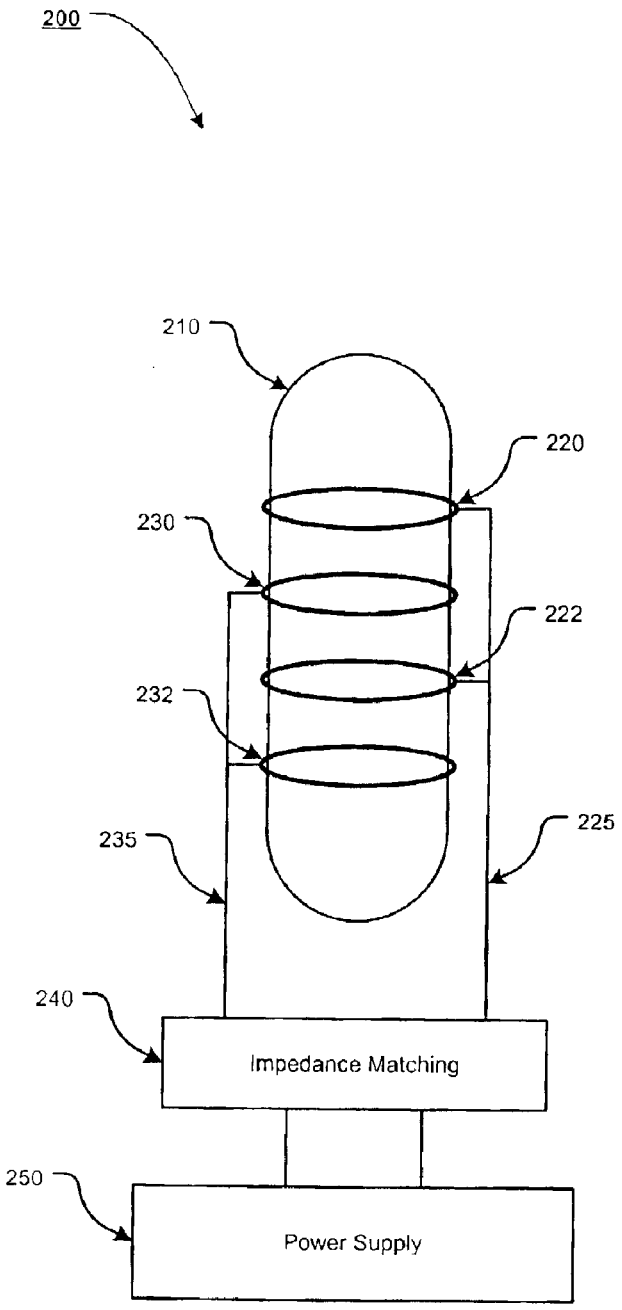
FIG. 2 shows a second exemplary embodiment of a electrodeless excimer LV lamp system according to this invention.

FIG. 2 shows a second exemplary embodiment of an electrodeless excimer UV lamp system 200 according to this invention. As shown in FIG. 2, the electrodeless excimer UV lamp system 200 includes at least some of a lamp chamber 210, a first electrode 220, a second electrode 230, and a power supply 250. The first electrode 220 and the second electrode 230 are each connected, either directly or indirectly, to the power supply 250, via a first electrode connector 225 and a second electrode connector 235, respectively. In various exemplary embodiments, the first electrode 220 and the second electrode 230 are each connected, via an impedance matching network 240, to the power supply 250.

It should be understood that the lamp chamber 210, the first electrode 220, the first electrode connector 225, the second electrode 230, the second electrode connector 235, the optional impedance matching network 240, and the power supply 250 correspond to and operate similarly to the same elements described above with reference to FIG. 1.

However, as shown in FIG. 2, the electrodeless excimer UV lamp system 200 includes a third electrode 222 and a fourth electrode 232. The third electrode 222 and the fourth electrode 232 are each connected, either directly or indirectly, to the power supply 250, via the first electrode connector 225 and the second electrode connector 235, respectively. In various exemplary embodiments, the third electrode 222 and the fourth electrode 232 are each connected, via the impedance matching network 240, to the power supply 250.

As shown in FIG. 2, the first electrode 220, the second electrode 230, the third electrode 222, and the fourth electrode 232 are placed around the outer surface of the lamp chamber 210 in a cascaded fashion. By cascading two pairs of electrodes around the outer surface of lamp chamber 210, a larger plasma discharge volume may be created within the lamp chamber 210. Likewise, and a larger UV emission area can be created within the lamp chamber 210. This ultimately increases the UV output of the electrodeless excimer UV lamp system 200 as compared to the UV output of the electrodeless excimer UV lamp system 100, as discussed above with reference to FIG. 1.

In various other exemplary embodiments (not shown) additional pairs of electrodes may be added around the outer surface of the lamp chamber 210, such that, by adding additional pairs of electrodes and lengthening the lamp chamber 210, if necessary, a plasma discharge of any desired length or volume can be generated. It should be understood that as the number of additional pairs of electrodes increases, the power requirement increases as well.

Figure 3:
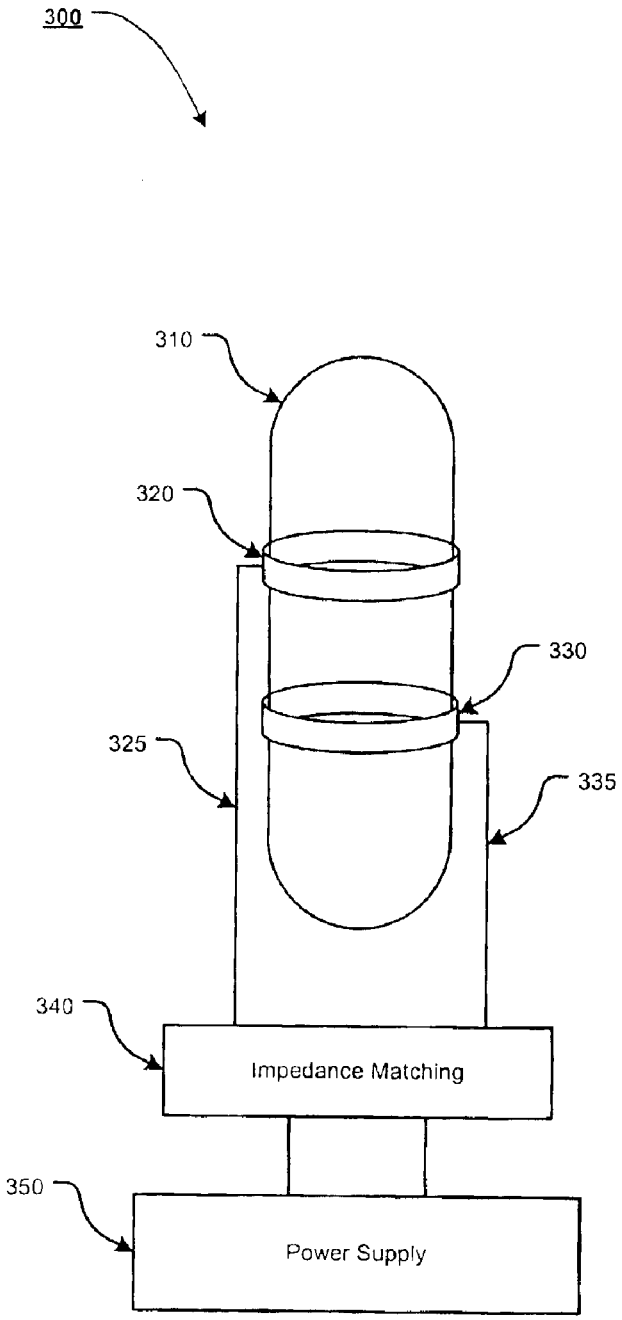
FIG. 3 shows a third exemplary embodiment of a electrodeless excimer UV lamp system according to this invention.

FIG. 3 shows a third exemplary embodiment of an electrodeless excimer UV lamp system 300 according, to this invention. As shown in FIG. 3, the electrodeless excimer UV lamp system 300 includes at least some of a lamp chamber 310, a first electrode 320, a second electrode 330, and a power supply 350. The first electrode 320 and the second electrode 330 are each connected, either directly or indirectly, to the power supply 350, via a first electrode connector 325 and a second electrode connector 335, respectively. In various exemplary embodiments, the first electrode 320 and the second electrode 330 are each connected, via an impedance matching network 340, to the power supply 350.

It should be understood that the lamp chamber 310, the first electrode connector 325, the second electrode connector 335, the optional impedance matching network 340, and the power supply 350 correspond to and operate similarly to the same elements described above with reference to FIG. 1.

However, as shown in FIG. 3, the first electrode 320 and the second electrode 330 generally form a collar as opposed to a wire, as described above with reference to FIGS. 1 and 2. In various exemplary embodiments, the first electrode 320 and the second electrode 330 are formed from sheet metal, such as, for example, from a copper sheet.

The width of the first electrode 320 and the second electrode 330 may vary between approximately several millimeters to approximately several centimeters. The actual width of the first electrode 320 and the second electrode 330 is a function of, for example, the desired discharge volume of UV radiation, the power to be supplied to the first electrode 320 and the second electrode 330, and the diameter of the lamp chamber 310. In various exemplary embodiments, the first electrode 320 and the second electrode 330 have a width of approximately 5 mm.

Figure 4:
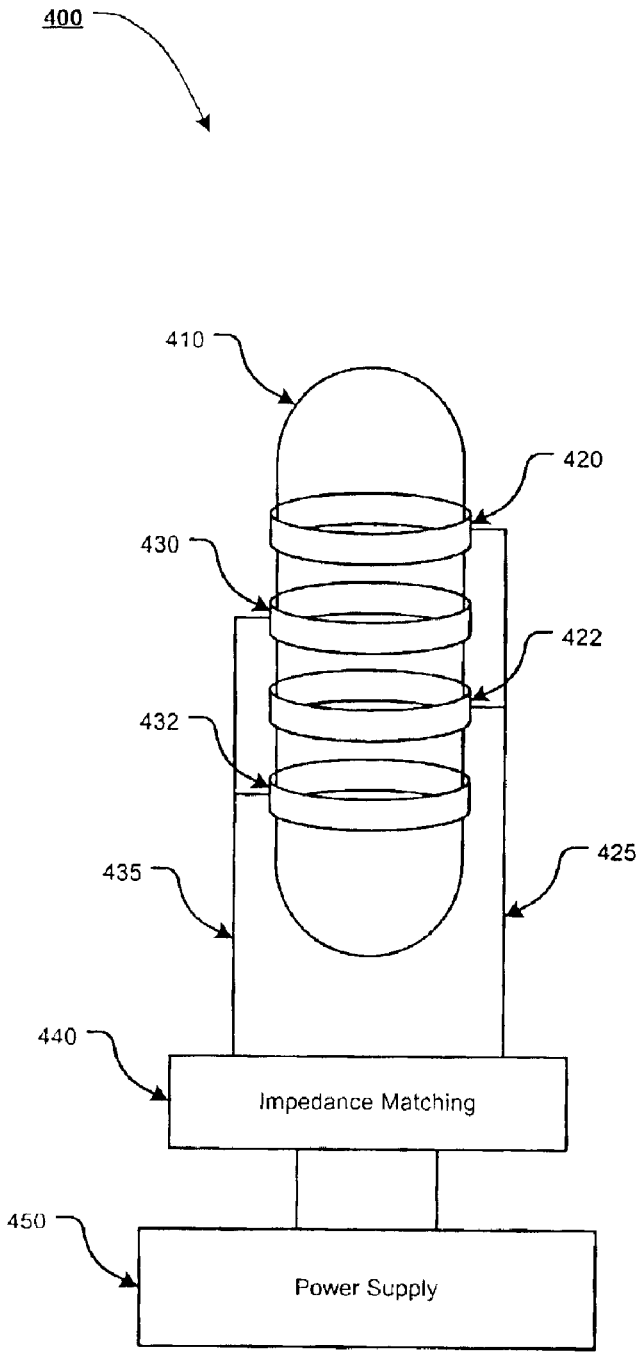
FIG. 4 shows a fourth exemplary embodiment of a electrodeless excimer UV lamp system according to this invention.

FIG. 4 shows a fourth exemplary embodiment of an electrodeless excimer UV lamp system 400 according to this invention. As shown in FIG. 4, the electrodeless excimer UV lamp system 400 includes at least some of a lamp chamber 410, a first electrode 420, a second electrode 430, and a power supply 450. The first electrode 420 and the second electrode 430 are each connected, either directly or indirectly, to the power supply 450, via a first electrode connector 425 and a second electrode connector 435, respectively. In various exemplary embodiments, the first electrode 420 and the second electrode 430 are each connected, via an impedance matching network 440, to the power supply 450.

It should be understood that the lamp chamber 410, the first electrode 420, the first electrode connector 425, the second electrode 430, the second electrode connector 435, the optional impedance matching network 440, and the power supply 450 correspond to and operate similarly to the same elements described above with reference to FIG. 3.

However, as shown in FIG. 4, the electrodeless excimer UV lamp system 400 includes a third electrode 422 and a fourth electrode 432. The third electrode 422 and the fourth electrode 432 are each connected, either directly or indirectly, to the power supply 450, via the first electrode connector 425 and the second electrode connector 435, respectively. In various exemplary embodiments, the third electrode 422 and the fourth electrode 432 are each connected, via the impedance matching network 440, to the power supply 450.

As shown in FIG. 4, the first electrode 420, the second electrode 430, the third electrode 422, and the fourth electrode 432 are placed around the outer surface of the lamp chamber 410 in a cascaded fashion. Thus, the electrodeless excimer UV lamp system 400 operates similarly to the electrodeless excimer UV lamp system 200, as discussed above with reference to FIG. 2.

Figure 5:
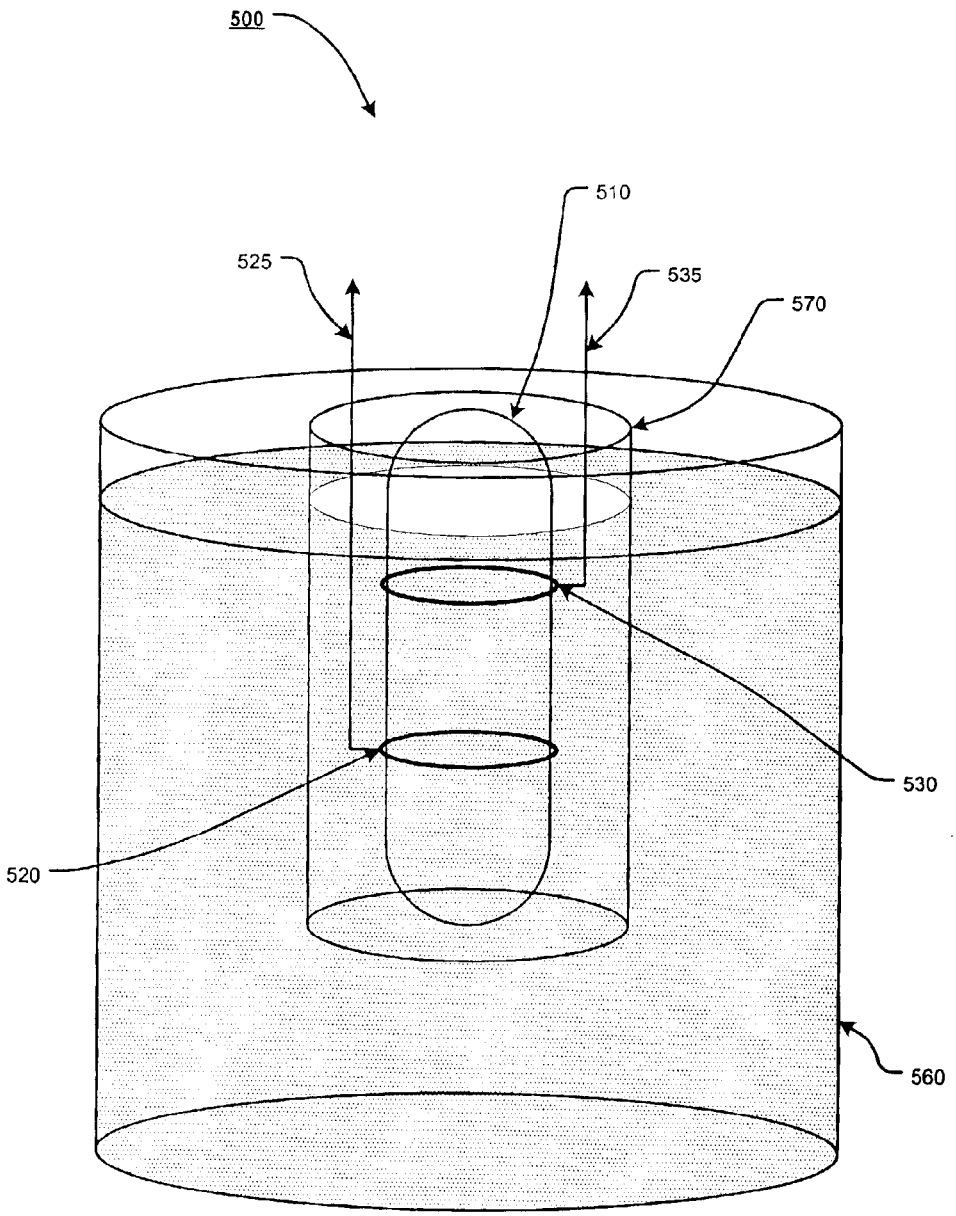
FIG. 5 shows a first exemplary embodiment of one possible application of the electrodeless excimer UV lamp for the decontamination of a liquid according to this invention.

FIG. 5 shows a first exemplary embodiment of one possible application of the electrodeless excimer UV lamp system 500 for the decontamination of a liquid according to this invention. As shown in FIG. 5, the electrodeless excimer UV lamp system 500 includes at least some of a lamp chamber 510, a first electrode 520, a first electrode connector 525, a second electrode 530, and a second electrode connector 535.

The first electrode 520 and the second electrode 530 are each connected, either directly or indirectly, to the power supply 550 (not shown), via a first electrode connector 525 and a second electrode connector 535, respectively. In various exemplary embodiments, the first electrode 520 and the second electrode 530 are each connected, via an optional impedance matching network 540 (not shown), to the power supply 550 (not shown).

It should be appreciated that the lamp chamber 510, the first electrode 520, the first electrode connector 525, the second electrode 530, the second electrode connector 535, the optional impedance matching network 540 (not shown), and the power supply 550 (not shown) correspond to and operate similarly to the same elements described above with reference to the electrodeless excimer UV lamp system 100 of FIG. 1. However, it should also be appreciated that the electrodeless excimer UV lamp system 500, as shown in FIG. 5, may optionally include the requisite elements and may operate similarly to the electrodeless excimer UV lamp system 200, the electrodeless excimer UV lamp system 300, or the electrodeless excimer UV lamp system 400, as described above with reference to FIG. 2, FIG. 3, or FIG. 4.

As further shown in FIG. 5, the electrodeless excimer UV lamp system 500 also includes a decontamination chamber 560 and a lamp sheath 570. During operation of the electrodeless excimer UV lamp system 500, a bacterially or otherwise contaminated liquid is placed in the chamber 560. The liquid may be placed in the chamber 560 such that it is substantially stagnate or a constant flow of liquid may enter the chamber 560 as an influent and leave the chamber 560 as an effluent. In embodiments wherein the liquid flows through the chamber 560, the chamber 560 includes an inlet (not shown) and an outlet (not shown).

When the contaminated liquid is placed in the chamber 560, the lamp sheath 570 acts as a barrier to isolate the electrodeless excimer UV lamp system from the liquid. It should be appreciated that in various exemplary embodiments, the lamp sheath 570 is formed from a non-conductive material that is transparent or translucent to UV propagation.

As a plasma discharge is generated by the electrodeless excimer UV lamp, bacteria in the liquid are killed and the liquid is disinfected or decontaminated. It should be appreciated that particular wavelengths of UV radiation may be used, for example, to kill particular types of bacteria.

The volume of liquid that may be decontaminated by the electrodeless excimer UV lamp system 500 during a given time period will depend upon certain factors, such as, for example, the type of bacteria or contaminant present, the UV resistance of the bacteria or contaminant, and the intensity and wavelength of the UV radiation.

In one example, a half liter of contaminated water was exposed to UV radiation with a density of 8 $mW/Cm^2$. Within 3 to 5 minutes, greater than 99% of the bacteria within the contaminated water was killed.

In various exemplary embodiments, the electrodeless excimer UV lamp system 500 may include multiple electrodeless excimer UV lamps. It should be appreciated that the electrodeless excimer UV lamp system 500 is scalable based on the volume of liquid that is to be disinfected or decontaminated.

While this invention has been described in conjunction with the exemplary embodiments outlined above, it is evident that many alternatives, modifications, and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An apparatus for generating a plasma discharge, comprising:

a chamber made of a non-conducing material, wherein the chamber includes an outer surface and an inner surface, and wherein the chamber is enclosed;

a gas sealed within the enclosed chamber, wherein the gas is capable of generating a plasma discharge;

a first electrode wrapped around the outer surface of tee chamber at a first location;

a second electrode wrapped around the outer surface of the chamber at second location;

wherein the first electrode and the second electrode, are capacitively coupled to the plasma discharge; and a power supply configured to apply a voltage to the first electrode and the second electrode and generate a capacitively coupled plasma discharge within the enclosed chamber.

2. The apparatus of claim 1, wherein the chamber is formed from a ton-conductive material that is transparent or translucent to UV propagation.

3. The apparatus of claim 1, wherein the chamber is formed from a non-conductive material selected from the group consisting of fused silica, quartz, glass, calcium fluoride, and magnesium fluoride.

4. The apparatus of claim 1, wherein the chamber includes at least one portion that is formed from a non-conductive material that is opaque to UV propagation, and at least one window portion that is formed from a non-conductive material that is transparent or translucent to UV propagation.

5. The apparatus of claim 4, wherein the at least one UV opaque portion is formed from a material selected from the group consisting of ceramic and alumina.

6. The apparatus of claim 1, wherein the gas is a noble gas.

7. The apparatus of claim 1, wherein the gas is selected from the group consisting of helium, argon, krypton, and xenon.

8. The apparatus of claim 1, wherein the gas is a gas mixture.

9. The apparatus of claim 1, wherein the gas is a mixture of a noble gs and a halogen gas.

10. The apparatus of claim 1, wherein the gas is a gas mixture containing at least some of a gas selected from the group consisting of krypton/chlorine, xenon/chlorine, and argon/chlorine.

11. The apparatus of claim 1, where the first electrode and the second electrode are physically separate and independent, but electrically interconnected.

12. The apparatus of claim 1, wherein the first electrode and the second electrode are made of a conductive wire.

13. The apparatus of claim 1, wherein the first electrode and the second electrode are made of a conductive strip.

14. The apparatus of claim 1, wherein the first electrode and the second electrode are each made of a conductive strip, each having a width of approximately 5 mm.

15. The apparatus of claim 1, wherein the first electrode and the second electrode are removably wrapped around the outer surface of the chamber.

16. The apparatus of claim 1, wherein the power supply is an AC voltage source generating an AC voltage in a range of about 200 V to about 5 kV and having a frequency in the range of about 1 kHz to about 100 MHz.

17. The apparatus of claim 1, farther comprising an impedance matching network configured between the power supply and the first electrode and the second electrode, such that the voltage is applied to the first electrode and the second electrode through the impedance matching network.

18. The apparatus of claim 1, wherein two or more pairs of electrodes are wrapped around the outer surface of the chamber at different locations in a cascading manner.

19. A method for generating a plasma discharge, wherein the apparatus for generating the plasma discharge comprises a chamber made of a on-conducting material, wherein the chamber includes an outer surface and an inner surface and wherein the chamber is enclosed; a gas sealed within the enclosed chamber, wherein the gas is capable of generating a plasma discharge; at least one pair of electrodes wrapped around the outer surface of the chamber, wherein the at last one lair of electrodes are capacitively coupled to the plasma discharge; and a power supply configured to apply a voltage to the electrodes, comprising the steps of:

applying a voltage to the at least one pair of electrodes to ignite the gas inside the chamber and generate a plasma discharge within the chamber, such that a specific wavelength of UV radiation will be generated by the plasma within the chamber.

20. A method for generating a plasma discharge, comprising the steps of:

sealing a gas within an enclosed chamber, wherein the chamber is made of a non-conducting material and includes an outer surface and an inner surface, and wherein the gas is capable of generating a plasma discharge;

applying a sufficient voltage to a first electrode and a second electrode to ignite the gas sealed within the chamber and generate a plasma discharge inside the chamber, wherein the first electrode and the second electrode are each wrapped around the outer surface of the chamber at a different location, and wherein the first electrode and the second electrode are capacitively coupled to the plasma discharge.

21. The method of claim 20, wherein the chamber is formed from a non-conductive material that is transparent or translucent to UV propagation.

22. The method of claim 20, wherein the chamber includes at least one portion that is formed from a non-conductive material that is opaque to UV propagation, and at least one window portion that is formed from a non-conductive material that is transparent or translucent to UV propagation.

23. The method of claim 22, wherein the at least one UV opaque portion is formed from a material selected from the group consisting of ceramic and alumina.

24. The method of claim 20, wherein the gas is a noble gas.

25. The method of claim 20, wherein the gas is a gas mixture.

26. The method of claim 20, wherein the gs is a mixture of a noble gas and a halogen gas.

27. The method of claim 20, where the first electrode and the second electrode are physically separate and independent, but electrically interconnected.

28. The method of claim 20, wherein the first electrode and the second electrode are made of a conductive wire.

29. The method of claim 20, wherein the first electrode and the second electrode are made of a conductive strip.

30. The method of claim 20, wherein the first electrode and the second electrode are removably wrapped around the outer surface of the chamber.

31. The method of claim 20, wherein two or more pairs of electrodes are wrapped around the outer surface of the chamber at different locations in a cascading manner, and wherein the step of applying a sufficient voltage to a first electrode and a second electrode includes applying a sufficient voltage to each of the two or more pairs of electrodes to ignite the gs sealed within the chamber and generate a plasma discharge inside the chamber.

32. A kit for generating a plasma discharge, the kit comprising:

a cartridge made of a non-conducting material, wherein the cartridge includes an outer surface and an inner surface and wherein a gas is sealed within the cartridge, wherein the gas is capable of generating a plasma discharge;

a first electrode removably wrapped around at least a portion of the outer surface of the cartridge at a first location;

a second electrode removably wrapped around at least a portion of the outer surface of the cartridge at second location;

wherein the first electrode and the second electrode are capacitively coupled to the plasma discharge; and a power supply configured to apply a sufficient voltage to the first electrode and the second electrode to ignite the gas sealed within the cartridge and generate a plasma discharge inside the cartridge such that a specific wavelength of UV radiation is generated by the plasma within the cartridge.

33. The kit of claim 32, wherein the cartridge is formed from a non-conductive material that is transparent or translucent to UV propagation.

34. The kit of claim 32, wherein the cartridge is formed from a non-conductive material selected from the group consisting of fused silica, quartz, glass, calcium fluoride, and magnesium fluoride.

35. The kit of claim 32, wherein the cartridge includes at least one portion that is formed from a non-conductive material that is opaque to UV propagation, and at least one window portion that is formed from a non-conductive material that is transparent or translucent to UV propagation.

36. The apparatus of claim 35, wherein the at least one UV opaque portion is formed from a material selected from the group consisting of ceramic and alumina.

37. The kit of claim 32, wherein the gas sealed within the cartridge is a noble gas.

38. The kit of claim 32, wherein the gas sealed within the cartridge is selected such that a specific wavelength of WV radiation is generated by the plasma.

39. The kit of claim 32, wherein the gas sealed within the cartridge is a gas mixture.

40. The kit of claim 39, wherein the gas mixture sealed within the cartridge is selected such that a specific wavelength of UV radiation is generated by the plasma.

41. A plasma discharge component, comprising:

a cartridge made of a non-conducting material, wherein the cartridge includes an outer surface and an inner surface, wherein a gas is sealed within the cartridge, wherein the gas is capable of generating a plasma discharge, wherein the gas sealed within the cartridge is selected such that a specific wavelength of UV radiation is generated by the plasma, and wherein the cartridge is removably placed within at least a first electrode and a second electrode, wherein the first electrode and the second electrode are capacitively coupled to the plasma discharge and wherein the first electrode and the second electrode are connectable to a power supply configured to apply a sufficient voltage to the at least first electrode and the at least second electrode to ignite the gas sealed within the cartridge and generate a plasma discharge inside the cartridge such that a specific wavelength of UV radiation is generated by the plasma within the cartridge.

* * * * *